United States Patent [19]

Cox et al.

[11] 4,302,643

[45] Nov. 24, 1981

[54] FUSIBLE SWITCH

[75] Inventors: Russell Cox, Frankfort; Joseph C. Drilling, Lexington; Ronald H. Reed, Versailles, all of Ky.

[73] Assignee: Square D Company, Palatine, Ill.

[21] Appl. No.: 89,002

[22] Filed: Oct. 29, 1979

[51] Int. Cl.[3] ..... H01H 33/08; H01H 9/02

[52] U.S. Cl. ..... 200/144 R; 200/144 C; 200/147 R; 200/162; 200/254; 200/293; 337/9

[58] Field of Search ..... 200/144 R, 147 R, 162, 200/254, 255, 293, 151; 337/9

[56] References Cited

U.S. PATENT DOCUMENTS

| | | | |
|---|---|---|---|
| 2,325,697 | 8/1943 | Millermaster et al. | 200/151 |
| 2,590,543 | 3/1952 | Kalaway | 200/144 R |
| 2,769,066 | 10/1956 | Cellerini | 200/147 R |
| 3,684,849 | 8/1972 | Zubaty | 200/162 |
| 3,761,660 | 9/1973 | Jones | 200/144 C |
| 3,840,717 | 10/1974 | Pekrul et al. | 337/9 |
| 3,873,791 | 3/1975 | Hurtle | 200/144 C |

*Primary Examiner*—Robert S. Macon

*Attorney, Agent, or Firm*—Norton Lesser; Larry I. Golden; Richard T. Guttman

[57] ABSTRACT

The following specification describes a fusible switch assembly having a thermoplastic base supporting a plurality of pivotal knife blades. A one piece thermoplastic arc suppressor housing common to a plurality of phases is also described together with arc suppressor plates snap fit in the housing and a common one piece thermoplastic rotor for moving the blades. The rotor is retained by engagement with the knife blades and walls of the base.

23 Claims, 11 Drawing Figures

FUSIBLE SWITCH

BACKGROUND OF THE INVENTION

1. Field of the Invention

This invention relates in general to multiphase switches and more particularly to an improved and more economical fusible switch assembly.

2. Summmary of the Prior Art

A fusible switch is usually mounted in an enclosure and incorporates an insulating base and arc suppressor housing formed from a cold mold insulating material which may include asbestos. The base carries an incoming line terminal for each phase of a multiphase circuit with a switch for each phase having a pivotable knife blade operable to engage a stationary spring contact and extend a respective circuit through a fuse clip having a fuse seated therein. The arc suppressor housing overlaps the stationary contact of the switch and contains arc suppressor plates with the suppressor housing and plates being slotted to pass the movable knife blade.

In U.S. Pat. No. 3,590,200 a rotor of insulating material is shown located below a partition wall with the rotor held in a pivot position by a spring adjacent one end of the rotor. The knife blades projected from their pivots adjacent respective fuse clips into respective notches in the rotor for movement in opposite directions in response to pivoting movement of the rotor in a respective direction. Other arrangements such as shown in a copending application filed simultaneously herewith by Drilling and Reed utilize a one piece rotor having a pivot boss extending through a compartment wall and retained in the base by a C ring with the pivot boss being located on a radial arm of the rotor. Both arrangements are complicated and space consuming.

While the above mentioned patent did not show a suppressor housing, as may be seen from U.S. Pat. Nos. 3,706,868; 3,575,566; 3,596,026 and 3,588,413 and from the aforementioned application it is a practice to provide an arc suppressor housing assembly with U shaped arc suppressor plates in the housing assembly simply resting in respective grooves and retained between several parts of the housing assembly. The arrangement requires disassembly of the several housing parts from each other for replacement of the plates.

SUMMARY OF THE INVENTION

The present invention incorporates a thermoplastic material for the insulating base and for the arc suppressor housing of a fusible switch assembly. Such material represents a substantial departure from cold mold or thermosetting materials and eliminates the use of asbestos in the base or housing while providing the needed electrical and mechanical characteristics.

A one piece rotor formed solely of similar insulating material to the base has passages receiving the blades for both supporting the blades on the base and for moving the blades between an On and Off position. The rotor is engaged in passages in the base upper compartment walls to prevent longitudinal movement of the rotor relative the knife blades. The rotor is also provided with a plurality of spaced surface ribs between the blades and overlapping a portion of the base upper compartment walls to provide a high resistance path against electrical surface leakage or arc currents between the phases.

The fuse clips, knife blades and stationary contacts are also aligned in adjacent closely spaced compartments to thereby enable the compartments of each phase to be spaced more closely and thereby reduce the space requirements of the switch assembly.

A single arc suppressor housing removable by a single screw accessible from the top of the switch assembly is also provided and the arc suppressor plates are snap fittingly retained in the housing. The plates are formed in integral pairs by folding a single member about a transverse axis to provide two offset spring biased U shaped plates each having a tongue and groove at one end snap fitted behind a respective detent in the housing to retain the same and permit facile removal and replacement of the arc suppressor plates.

It is therefore one object of the present invention to provide an improved and more economical multiphase switch assembly.

It is another object of the present invention to provide an insulating material of improved character for a fusible switch assembly.

It is yet another object of the present invention to provide an improved or more economical arc suppressor assembly for a multiphase switch assembly.

It is still a further object of the present invention to provide an easily assembled rotor for a fusible switch assembly.

Other objects and features of the present invention will become apparent on examination of the following specification and claims together with the drawings.

DESCRIPTION OF THE PREFERRED EMBODIMENT

Figure 1:
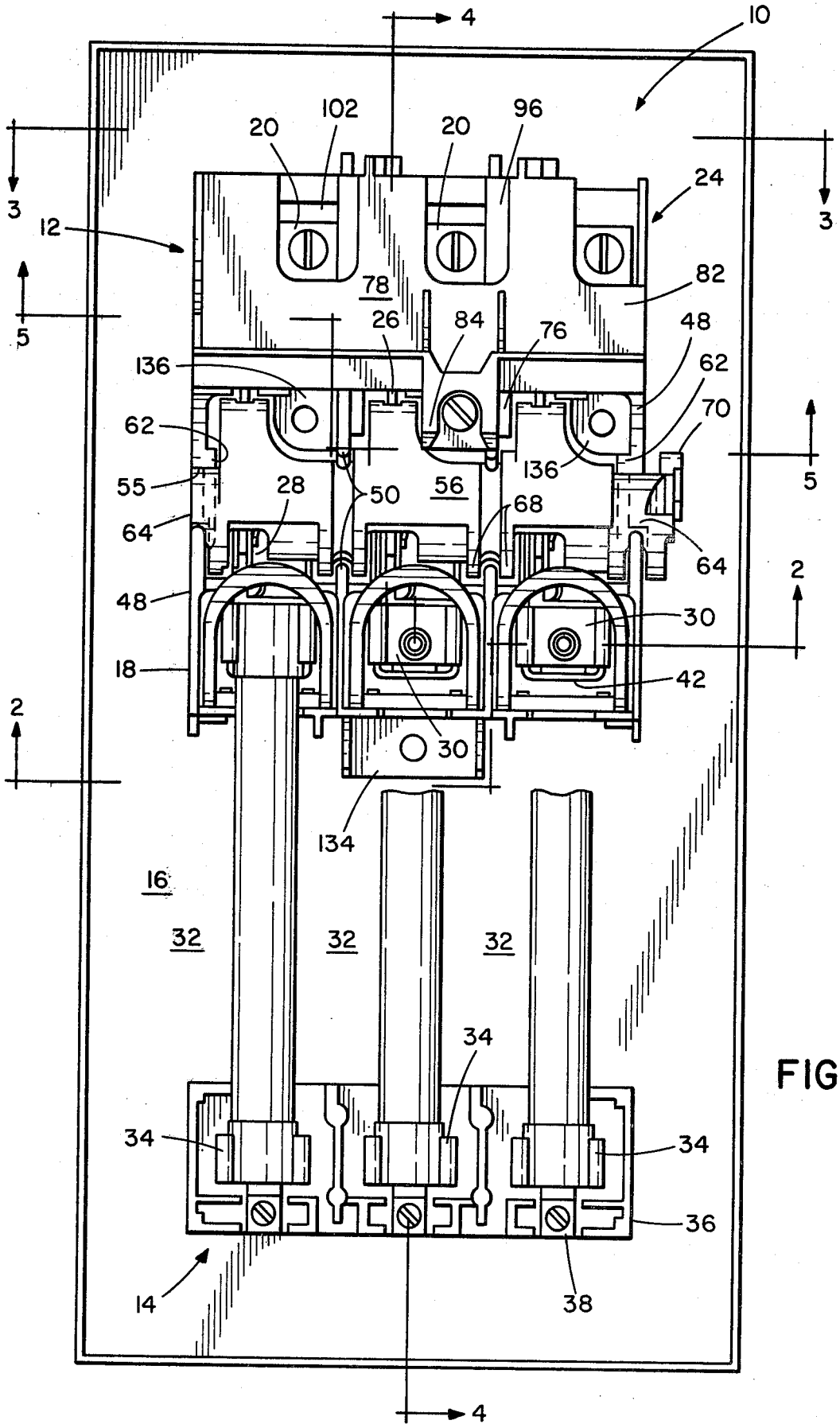
FIG. 1 is a top plan view of a relevant portion of a fusible switch assembly incorporating the principles of the present invention.

In FIG. 1 a fusible switch assembly for a multiphase circuit is indicated by the reference character 10. The switch assembly comprises a line base assembly 12 and a load base assembly 14 mounted a selected distance apart on a wall of an enclosure 16.

The line base assembly 12 includes an insulating base 18 integrally formed of a thermoplastic insulating material such as sold by the General Electric Company under the name Valox 420 or 750 carrying a plurality of spaced apart line lug terminals 20 adjacent one end of the base and adapted to be connected to a respective phase of an incoming multiphase circuit carrying for example 30 amps in any well known manner. The terminals 20 each connect to a respective switch contact 22 best seen in FIGS. 4–7 and overlapped by an arc suppressor housing assembly 24.

Each switch contact 22 includes a pair of upstanding cantilever spring legs forming a pair of spring jaws for receiving a respective switch or knife blade 26 between the respective jaws. The blades 26 extend a respective connection from a respective terminal 20 and contact 22 through the respective blade and a respective L shaped blade terminal 28 to a respective fuse clip 30. A respective cylindrically shaped fuse 32 extends the electrical connection from a respective clip 30 to a clip 34 mounted on an insulating base 36 of the load base assembly 14. From the load base clip 34, a connection may be established to a load by means of a respective load terminal 38. It will be appreciated that the insulating bases are formed of the same material and are usually secured directly to the wall of the enclosure.

The terminals 20, contacts 22, terminals 28 and fuse clips 30 are securely mounted in spaced apart positions on a platform wall 40 of the insulating base 18 with the clips 30 in alignment with a respective clip 34 and the contacts 22 aligned with a respective blade 26 in turn aligned with a respective clip 30. Each clip comprises a pair of cantilever arcuate jaw members adapted to receive a respective circularly shaped terminal at a respective end of fuse 32 therebetween. A respective wire member 42 secured between the upper end of the respective jaw members of clips 30 and having a circular portion underlying the fuses 32 prevents overstressing the jaw members and may serve as a fuse rejection device to prevent the insertion of an improperly sized or rated fuse in the fuse clip.

Figure 2:
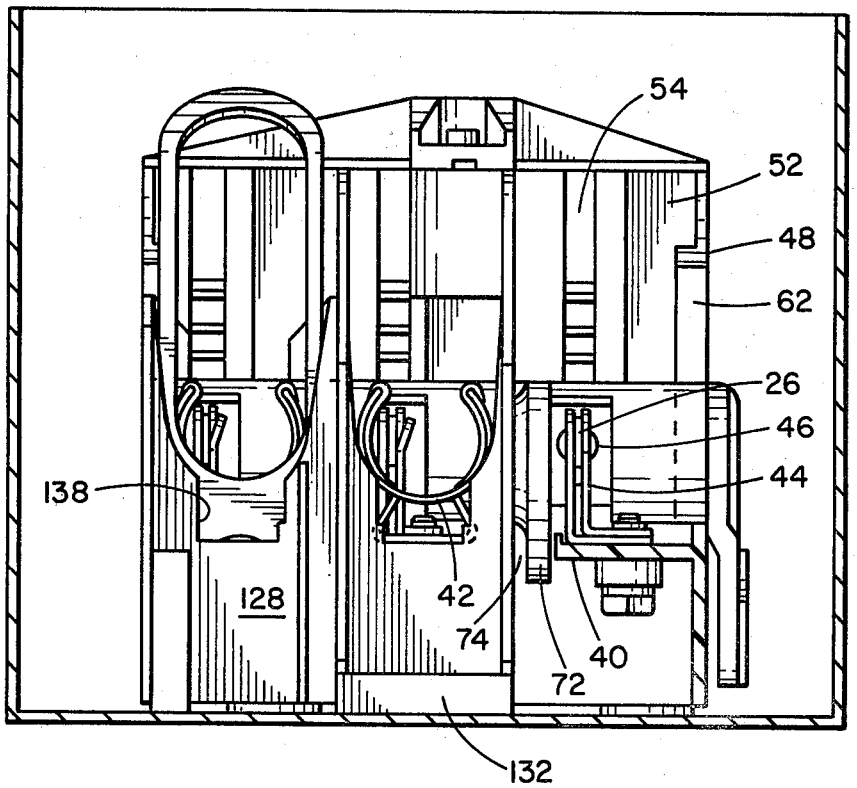
FIG. 2 is a sectional view taken through the line 2—2 in FIG. 1.

Each clip 30 has a planar back wall secured to platform wall 40 by a respective screw and a respective tang on the back leg of each clip 30 extends rearwardly and has a vertical leg formed thereon as seen in FIG. 2 to form one portion of terminal 28. The other portion of terminal 22 is formed by a vertical leg of an L shaped member 44 which is secured to the tang on the back leg of clip 30 and the platform wall 40. A respective blade 26 is secured between the vertical legs of terminal 28 by a rivet 46 or the like for pivoting movement about a common axis for each blade.

It will also be noted that each terminal 20 and contact 22 is secured to a stepped down portion of wall 40 by a common screw at a position offset from the respective terminal 20 and contact 22 by means of an integrally formed tang on each lug terminal 20 overlapping a folded offset portion of the rear wall of the respective contact 22.

The platform wall 40 has a pair of longitudinally extending spaced apart side compartment or barrier walls 48 and a pair of spaced apart barrier or compartment walls 50 between adjacent terminals, contacts, blades and clips. The barrier walls 48 and 50 project upwardly and downwardly from the platform wall and extend the length of wall 40 to form a compartment for each phase. A transverse barrier wall 52 extends between walls 48 at a position located adjacent the contacts 22 and has a slot 54 aligned with each contact 22 and blade 26 for passing the blade.

The compartment walls 48 and 50 are provided with respective aligned recesses 55 intermediate the wall 52 and terminals 28 for receiving a rotor 56 carried by the blades 26 as will be explained. The recesses in walls 50 are wider than the recesses in walls 48. The walls 48, 50 and 52 adjacent the contacts 22 also extend substantially above the rotor 56 and beyond the tips of the blades 26 in their highest rotatable position. The juncture of one wall 48 and wall 52 is also provided with a boss 58 adjacent the upper ends of the walls to which the arc suppressor assembly 24 is secured for overlapping the contacts 22.

The rotor 56 is thus seated between the edges of the recesses in walls 48 and 50 between the contacts 22 and terminals 28 and is provided with a respective passage 60 for each knife blade 26. A respective blade extends and projects through the passage 60 to thus carry the rotor on the knife blades and in turn on the terminals 28.

Figure 1A:
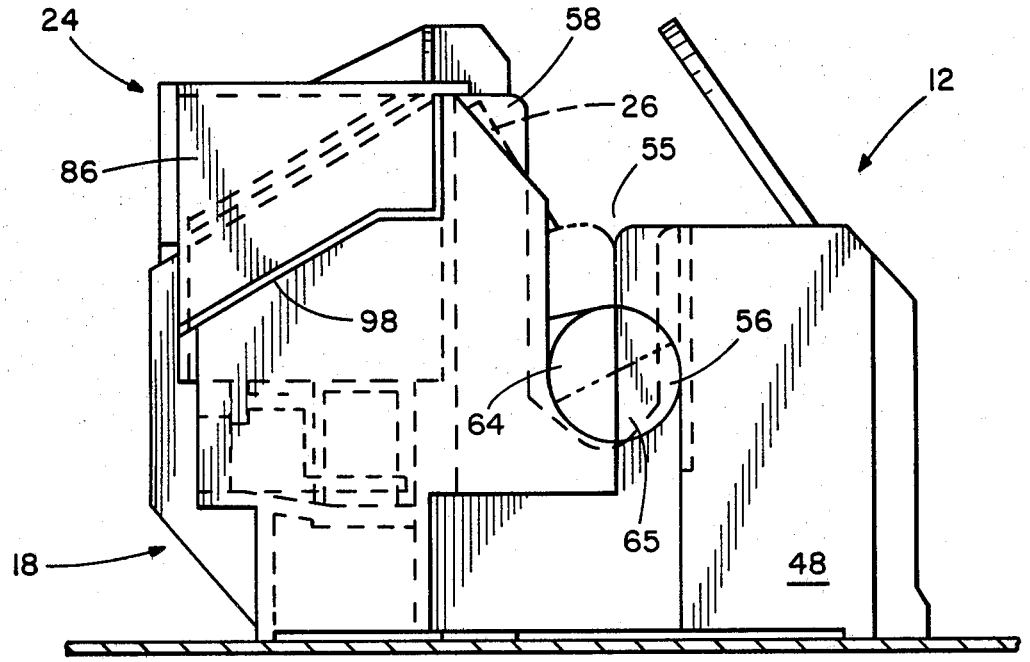
FIG. 1*a* is a side elevational view of the switch assembly shown in FIG. 1.
Figure 2A:
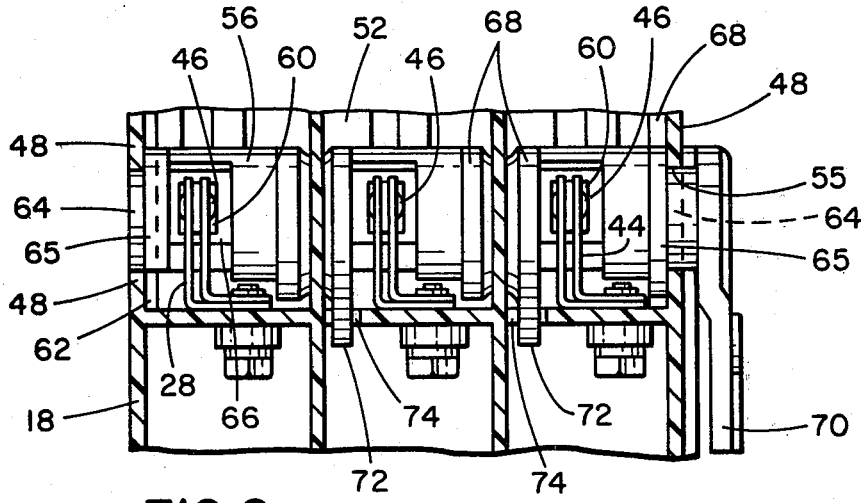
FIG. 2*a* is a fragmentary sectional similar to FIG. 2 taken adjacent the rotor passage in the compartment walls.

Each wall 48 adjacent the rear edge of the recess 55 is provided with an inwardly extending lip 62 having an arcuate bottom surface adjacent wall 40 for journalling a respective semi-circular portion 64 and a cylindrical portion 65 of the rotor. The upper end of the recess 55 in the side compartment walls 48 is sized to correspond on in to the radius of portion 64 to only pass a respective axially spaced rotor semi-circular portion 64 as seen best in FIG. 1*a*. The rotor and blades together with their terminals may be assembled to the base by passing the semi-circular portions 64 through the upper ends of the recess 55 in walls 48 with the rotor restrained from longitudinal movement relative the blades by the lip 62 and the rear edge of the respective wall recess 55 engaging the respective semi-circular portion 64. A mating arcuate portion is formed in the front edge of the recess 55 extending from adjacent the wall 40 on a diameter corresponding to the respective semi-circular portion 64 to journal the respective rotor semi-circular portion 64 during movement of the blades from a horizontal position as seen in the drawings to an open or OFF position as indicates by dashed lines in FIG. 1*a*. The rotor 56 is thus restrained from longitudinal movement relative the blades by the compartment walls 48 when it is seated in the recess 55. The rotor 56 also overlaps a portion of each terminal 28, which seats in a respective widened recess 66 of the rotor behind a respective passage 60. Respective lips 68 are also provided on the rotor for partially overlapping respective walls 50 and 48 to provide a long surface path of high electrical resistance while the walls of recess 66 and lips 68 minimize the possibility of arcing between terminals.

One end of the rotor 56 is also provided with a radially extending crank arm 70 whereby the rotor may be rotated in any well known manner by a handle assembly extending through a wall of the enclosure 16 to engage the blades with contacts 22 or for disengaging the blades from contacts 22.

To limit rotation of the rotor in each direction a pair of spaced apart stops 72 extend downwardly from the rotor through a respective slot 74 in the platform wall 40 when the blades are engaged with the contacts 22. The stops 72 are adapted to engage a respective stop 76 integrally formed at the juncture of walls 48 and 52 after the blades disengage from contacts 22 to limit rotation of the rotor in the opening direction.

Figure 3:
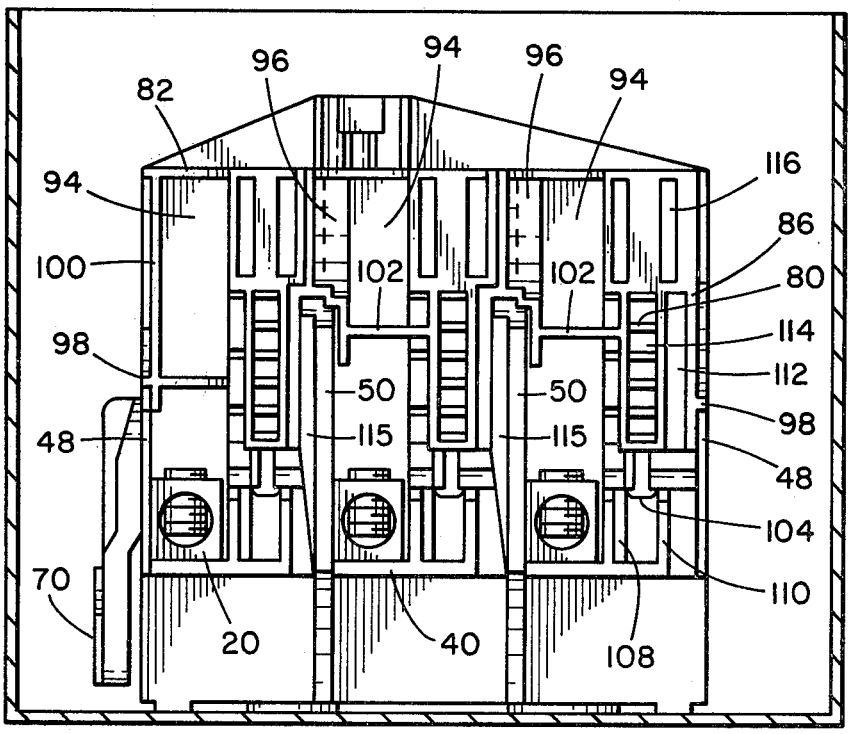
FIG. 3 is a sectional view taken generally along the line 3—3 in FIG. 1.

The arc suppressor assembly 24 comprises an integrally formed one piece housing 78 of similar thermoplastic material as the base carrying a plurality of pairs of arc suppressor plates 80 located in a respective stack overlapping each contact 22. The housing 78 includes a top wall 82 having a forwardly extending portion seating on transverse wall 52 and having a lip 84 extending forwardly thereof to overlap boss 58. A threaded fastener extending through lip 84 and into boss 58 to secure the housing 78 to the base 18. Depending from the top wall 82 are a plurality of pairs of spaced apart side walls 86 and 88 best seen in FIG. 5 forming a respective arc suppressor chamber 90 for each compartment with the front wall for each chamber formed by the wall 52. Inwardly extending longitudinal shelves or ribs 92 are formed on the facing surfaces of each side wall 86 and 88 to receive respective pair of integrally formed arc plates 80 in stacked spaced apart relationship. Each pair of spaced apart walls 86 and 88 straddle a respective contact 22 and a leading edge on walls 88 is received in a respective guide groove 93 in the rear surface of transverse wall 52. A transverse guide wall 94 best seen in FIG. 3 extends from each depending side wall 88 and the top wall 82 to engage the rear surface of wall 52.

A sloped stepped guide wall 96 extends rearwardly from wall 94 and is spaced from an adjacent wall 86 to nestingly receive a complementary stepped sloping upper edge portion of walls 50 behind wall 52. Walls 96 thus also supports the housing on the base. In addition rearwardly extending stop ribs 98 located respectively on one side wall 86 adjacent one wall 48 and on an offset end wall 100 of the housing 78 adjacent the other wall 48 cooperate with the respective portion of walls 48 to the rear of wall 52 for the same purpose as walls 96.

Struts 102 at the rear ends of walls 96 and 88 interconnect the walls 94 at the rear of each chamber to rigidify the housing 78. The lowermost shelves 92 at the bottom of walls 86 and 88 and are joined together at the rear end of each chamber and a depending stepped tongue 104 thereon is received by a corresponding stepped pair of short walls 108 and 110 projecting upwardly from rear end of platform wall 40. A ribbed rear wall 112 is also formed on housing 78 between each pair of side walls 86 and 88 and a vertically extending vent opening 114 is provided therein behind each arc stack. A rib 115 on the rear end of compartment walls 50 seats an adjacent portion of rear wall 112. It will be noted that walls 86, 88 and 112 extend above the uppermost shelves 92 and plates 80 to form a chamber above the arc plates and below wall 82 for gas expansion with openings 116 in rear wall 112 to vent the chamber.

Figure 9:
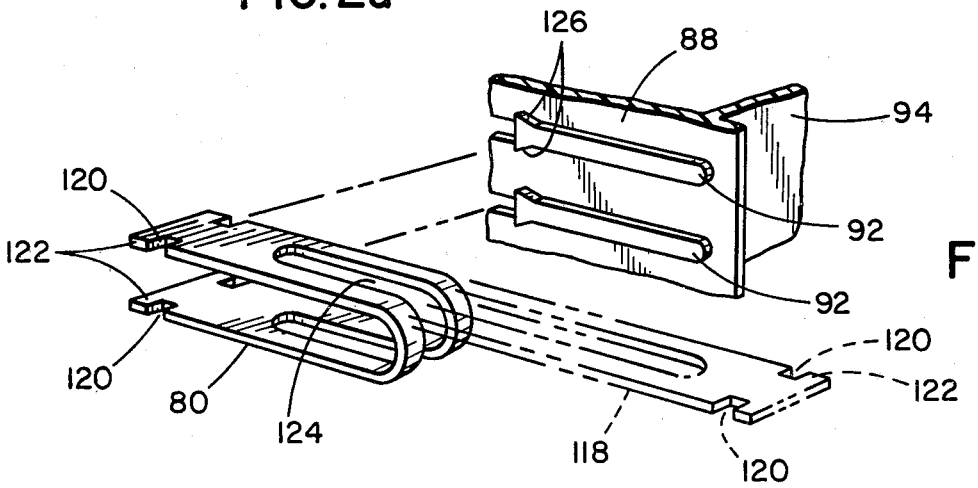
FIG. 9 is a fragmentary exploded isometric view of a pair of arc suppressor plates and associated arc suppressor housing portion.

The arc stack members or plates 80 are integrally formed in pairs from an elongate metal member 118 indicated by dashed lines in FIG. 9 and having spring characteristics. A passage or notch 120 is formed in each edge of the member 118 adjacent opposite ends to define a tongue 122. A central elongate encircled passage 124 is also formed in member 118 and when the member is folded back upon itself in a U shape to bring the tongues 122 at opposite ends into alignment, the passage 124 form a slot for a pair of plates. The passage 124 is aligned with the space between the jaws of contacts 22 to receive a respective knife blade when the pair of plates 80 are mounted in housing 24. Thus each member 118 actually forms a U with each leg of the U forming a plate 80.

The free ends of the legs of the U are inserted between a respective pair of shelves 92 until they engage a respective detent 126 extending from each shelf 92 on wall 88 as best seen in FIG. 9. The pair of plates 80 are then flexed toward each other by the ramp on the detents to pass the detents 126 whereafter the detents 126 snap fit in respective notches 120 as the spring pressure is relieved to thereby retain the plates in position until released.

With this arrangement insertion and retention of the plates is easily provided and since each leg is identical to the other no particular care is needed to align any particular plate leg with the shelves and detents. Removal of a pair of arc plates 80 for replacement simply proceeds by grasping the portion of the legs extending between the shelves with a pair of pliers and flexing the legs toward each other to disengage the notches 120 from detents 126 and then withdrawing the plates 80 from between the shelves.

An end wall 128 is provided at the forward end of the base 18. Wall 128 is spaced from the end of platform wall 40 and forwardly of clips 30 to define a slot or guideway 130 for receiving a fuse puller 132. A lower forwardly projecting lip 134 is also provided on wall 128 adjacent the central axis of the base together with a pair of spaced bosses 136 for receiving an easily accessible respective fastening device to secure the base in the enclosure 16.

The end wall 128 spans walls 48 and 50 below the platform wall 40 and merges with the walls 48 and 50 above wall 40 in an arcuate configuration of greater diameter than the fuses and jaws of clips 30 to permit receipt of the fuses. A guideway or recess 138 is formed in each arcuate portion of wall 128 along the central axis of each fuse clip 30 or compartment just below the fuses. The guideway 130 in wall 40 and the guideway 138 in the arcuate portion of wall 128 receive respective portions of fuse puller 132 whose movement in one direction is terminated by the bottom edge of guideway 138 and by a pair of detents 140 projecting upwardly from wall 40. Movement in the opposite direction to disengage a fuse 32 from a clip 30 is terminated by detents 142 on a bottom strut of the fuse puller 132 in a manner similar to that described in the aforementioned application filed simultaneously herewith by Berry and Drilling.

Figure 4:
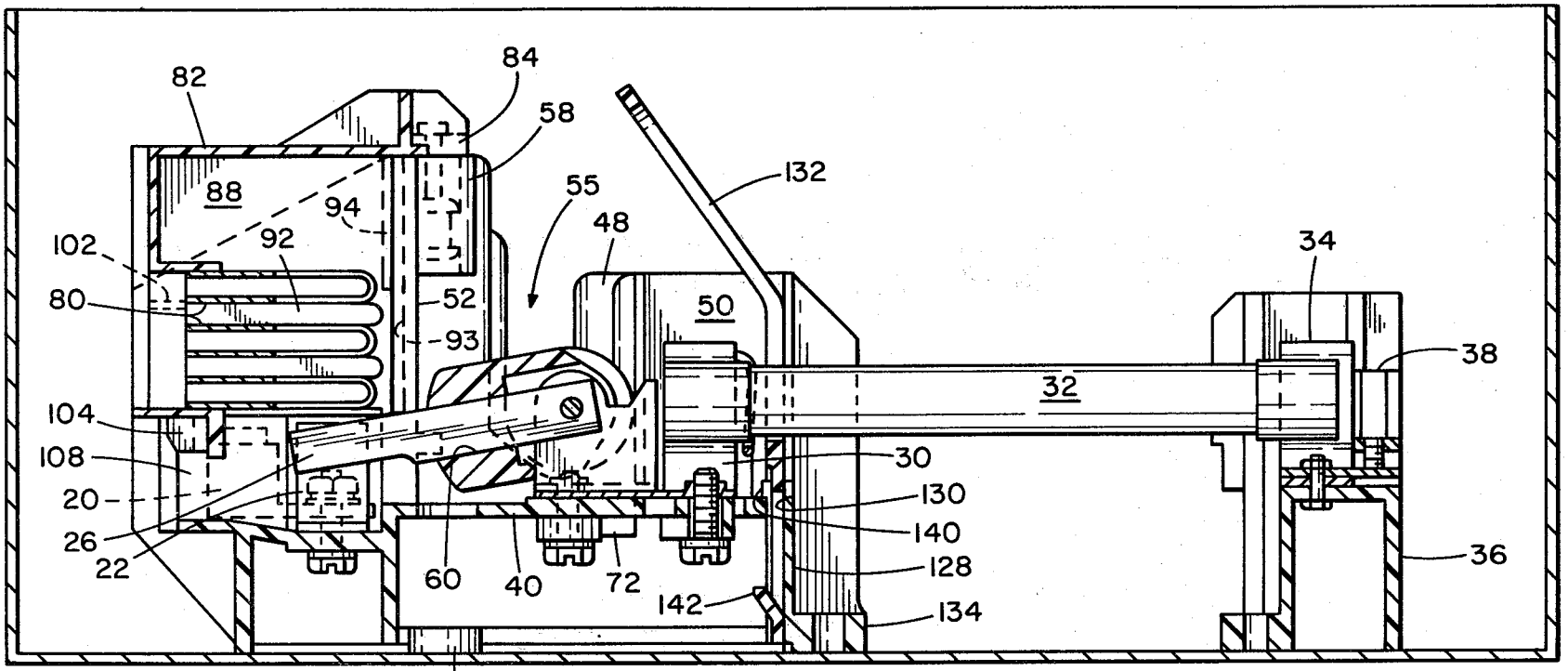
FIG. 4 is a sectional view taken through the line 4—4 in FIG. 1.
Figure 5:
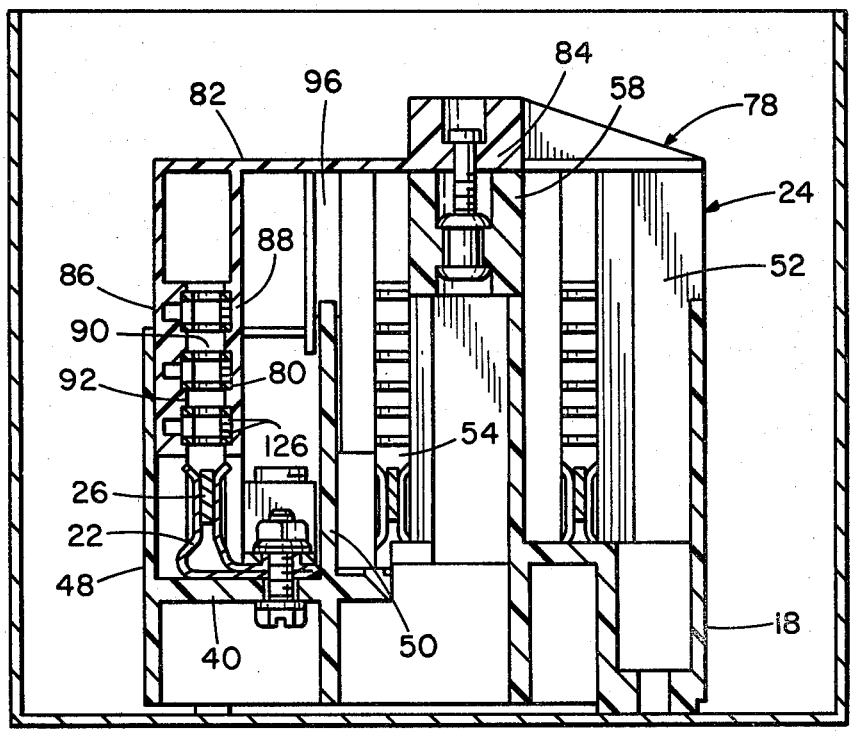
FIG. 5 is a sectional view taken through the line 5—5 in FIG. 4.
Figure 6:
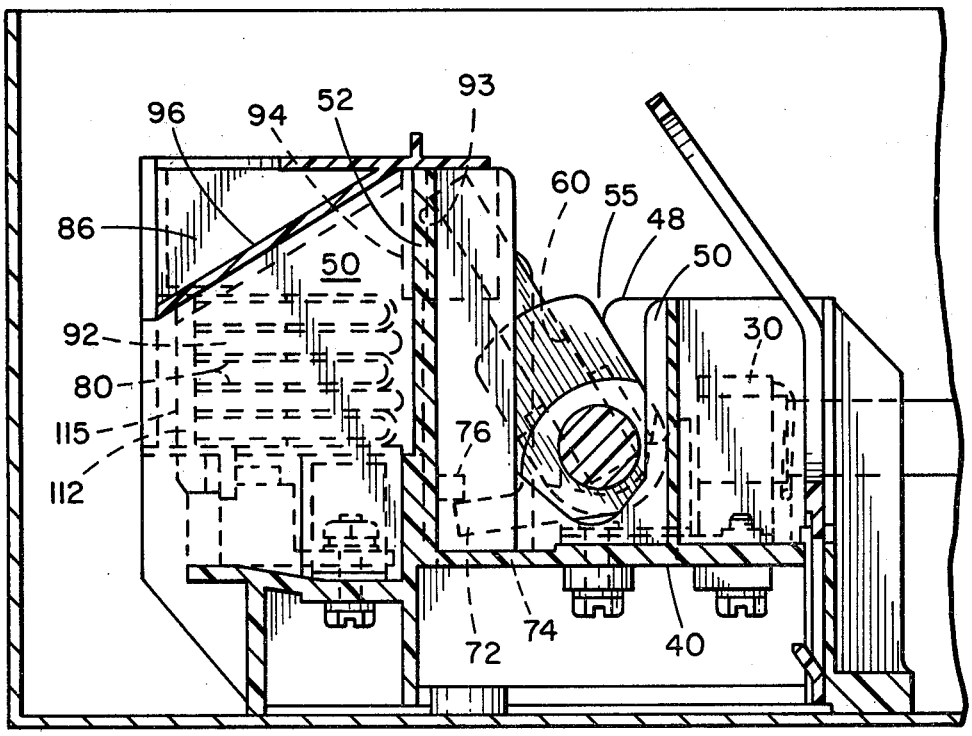
FIG. 6 is a sectional view of the line base illustrating the switch in the open or OFF position.
Figure 7:
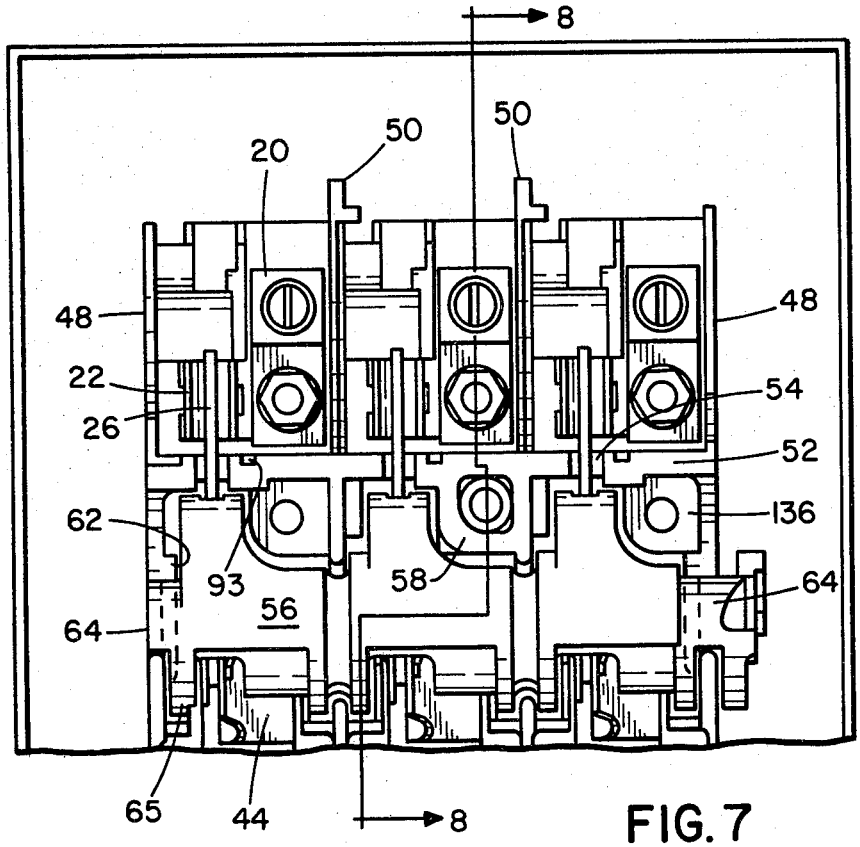
FIG. 7 is a fragmentary top elevational view with the arc suppressor housing removed.
Figure 8:
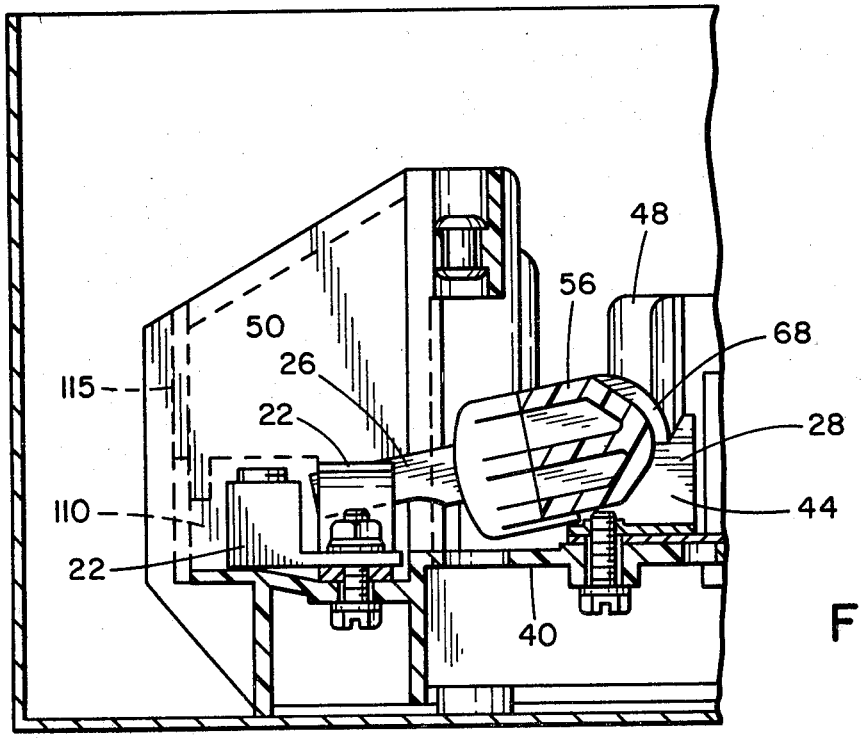
FIG. 8 is a sectional view taken through the line 8—8 in FIG. 7 illustrating a knife blade in the closed or ON position.

The operation of the fusible switch assembly 10 proceeds by movement of the crank arm 70. Crank arm 70 is conventionally moved by a handle assembly to rotate or pivot the rotor 56 about the pivot axis of the blades to thereby secure a substantial mechanical advantage for a quick make or break operation. A switch closing movement pivots the rotor 56 and blades 26 captured thereby in a counterclockwise direction as seen in FIG. 4 to pass each blade through the respective slot 54 in wall 52 to engage the blades between the legs of a respective spring contact 22 for completing a circuit to a respective fuse 32. The switch is then in the ON position. The end of slot in wall 40 may engage the rotor stop 72 to limit movement in the counterclockwise direction.

A switch opening movement is provided by operating the crank arm 70 in the opposite or clockwise direction with the large mechanical advantage serving to separate the blades from the respective spring contacts 22. Movement of the rotor and blades in the clockwise direction to the OFF position disengaging the blades 26 from contacts 22 is stopped when the rotor stops 72 engages the respective stop 76 on wall 52.

The foregoing is a description of an improved switch assembly whose inventive concepts are believed set forth in the accompanying claims.

What we claim is:

1. A fusible switch assembly for use in a multiphase circuit comprising:

an insulating base formed of an electrically insulating thermoplastic material including a platform wall having integrally formed spaced apart compartment walls to define adjacent compartments with each compartment corresponding to a respective phase, a line terminal in each compartment with each terminal secured to said platform wall adjacent one end of said platform wall, a respective switch contact in each compartment connected to each terminal and to said platform wall, a respective blade terminal in each compartment secured to said platform wall, a respective knife blade in each compartment pivotally carried by a respective blade terminal for pivoting movement about a common axis to engage and disengage each blade with a respective contact in response to pivoting movement of each blade in a respective direction, and a fuse clip in each compartment secured to said platform wall adjacent the end of said platform wall opposite said one end of said platform wall and connected to a respective knife blade terminal for extending an electrical connection from a respective line terminal to a respective fuse.

2. In the switch assembly claimed in claim 1, a rotor integrally formed of thermoplastic material carried by the blades above said platform wall for pivoting each blade about said axis simultaneously in response to pivoting movement of said rotor.

3. The switch assembly claimed in claim 2 in which said rotor has a plurality of passages each receiving a respective blade to enable the blades to carry said rotor, and respective integrally formed means on said rotor and on said base cooperating to restrain said rotor against longitudinal movement relative said blades.

4. In the switch assembly claimed in claim 3, integrally formed stop means on said base engaging said rotor in response to pivoting movement in a selected direction to limit the pivoting movement of said blades in said selected direction.

5. In the switch assembly claimed in claim 1, a one piece arc suppressor housing formed of thermoplastic material having a pair spaced apart integrally formed side walls for each compartment to define a respective arc suppression chamber for each compartment, a plurality of spaced apart arc suppressor plates in each chamber, means on said walls positioning said plates in a stack in each chamber, and respective integrally formed means on each of said plates and on a selected one of said side walls for retaining said plates between a respective pair of side walls in response to the movement of each plate to a respective position between said walls.

6. A fusible switch assembly for use in a multiphase circuit comprising:

an insulating base formed of a thermoplastic material including a platform wall having integrally formed spaced apart longitudinally extending compartment walls to define adjacent compartments on one side of said platform wall each corresponding to a respective phase, a line terminal in each compartment with each terminal secured to said platform wall adjacent the opposite end of said platform wall, a respective switch contact in each compartment connected to each terminal and secured to said platform wall, a respective blade terminal in each compartment secured to said platform wall, a respective knife blade in each compartment carried by a respective blade terminal for pivoting movement about a common axis to engage each blade with a respective contact in response to pivoting movement of the blades in one direction and disengaging each blade from the respective contact in response to pivoting movement of the blades in the opposite direction, a rotor formed of thermoplastic material supported on said blades for pivoting said blades about said common axis in said one and opposite directions, a fuse clip in each compartment secured to said platform wall adjacent said one end of said platform wall and connected to a respective knife blade terminal for extending an electrical connection from a respective terminal to a respective fuse, a common arc suppressor housing having spaced apart side walls to define a respective arc suppressor chamber for each compartment, a plurality of spaced apart arc suppressor members, means snap fittingly retaining each member in a respective chamber, and means on said housing and base positioning each chamber and plates in overlapping relationship to a respective switch contact.

7. In the switch assembly claimed in claim 6, respective means on said rotor and compartment walls restraining said rotor against longitudinal movement of said rotor relative said blades.

8. The switch assembly claimed in claim 7, in which each arc suppressor member has a central elongate passage and is folded about an axis transverse to said passage to form a pair of spaced apart suppressor plates with said passage defining a slot for each plate enabling passage of a respective blade.

9. The switch assembly claimed in claim 8, in which said means snap fittingly retaining each member comprises a detent for each member integrally formed on said housing, and a tongue formed along opposite edges of each member and adjacent opposite ends of said member with one tongue on each member moved in one direction past a respective detent to thereafter engage the respective detent for preventing movement of said member in the opposite direction.

10. In the switch assembly claimed in claim 7, a crank arm integrally formed on one end of said rotor and extending radially from said axis for enabling the facile pivoting of said rotor from a position offset from said axis.

11. In the switch assembly claimed in claim 6, in which each fuse clip includes a pair of spaced apart spring legs and the terminals, blades and contact in each compartment are located between a pair of parallel lines each extending from one leg of the respective clip.

12. A switch assembly for use in a multiphase circuit comprising:

an insulating base having a platform wall supporting a respective line terminal for each phase connected to a respective switch contact, a respective knife blade for each contact, integrally formed spaced apart compartment walls on said platform wall extending transverse to said platform wall to define adjacent compartments for a respective line terminal, switch contact and knife blade, a rotor overlapping said platform wall and formed of thermoplastic material having a plurality of passages each passing a respective knife blade to support said rotor on blades and for rotating the blades, a passage in each compartment wall enabling receipt of said rotor between said compartment walls, integrally formed means on said base journalling said rotor and restraining said rotor against longitudinal movement relative the said blades, and means securing each knife blade to said platform wall in a respective compartment for rotation by said rotor about a common axis to engage each blade with a respective contact.

13. In the assembly claimed in claim 12, in which said rotor includes a pair of axially spaced semi-circular portions for movement through a respective passage and said integrally formed means on said base includes an arcuate edge adjacent one end of the respective passage corresponding to the diameter of the respective portion of said rotor for journalling said rotor.

14. In the assembly claimed in claim 13, integrally formed stop means on said base engaged in response to pivoting movement of said rotor in a selected direction to prevent movement of said rotor past a selected limit position.

15. The switch assembly claimed in claim 12 in which said rotor includes a plurality of pairs of ribs spaced along said axis for receiving a portion of a respective compartment wall therebetween with said ribs forming a long path of high electrical resistance and overlapping a respective compartment wall to retard arcing.

16. In the assembly claimed in claim 12, a one piece arc suppressor housing having spaced apart integrally formed side walls to define a respective arc suppression chamber for each compartment, a unitary member forming a pair of U shaped arc suppressor plates in each chamber and defining a slot between the legs of each U shape for passing a respective knife blade, and integrally formed means on said housing and on each member for snap fittingly retaining each member between a respective pair of side walls.

17. A switch assembly for use with a multiphase circuit including an insulating base having a platform wall supporting a respective line terminal for each phase connected to a respective switch contact with each contact adapted to be engaged by a respective knife blade pivotally supported on said wall for rotation about a common axis with integrally formed spaced apart compartment walls projecting from said platform wall to define adjacent compartments for a respective line terminal, switch contact and knife blade, the improvement comprising:

a one piece arc suppressor housing having a plurality of pairs of spaced apart integrally formed side walls to define a respective arc suppression chamber between the side walls of each pair for each compartment, an arc suppression member in each chamber with each member having a slot aligned with a respective switch contact and enabling a respective knife blade to pass through the respective slot for engagement with a respective switch contact, means on each side wall for supporting a respective member therebetween, and respective means integrally formed on each member and at respective positions on said housing for snap fittingly securing each member between a respective pair of side walls in response to movement of the respective member past a predetermined position relative a respective pair of side walls.

18. The improvement claimed in claim 17 in which each member is folded in a U shape to form a pair of spaced arc suppression plates joined at one end with one plate overlapping the other plate and having a slot aligned with a slot in the other plate and with each plate having a fuse end.

19. The improvement claimed in claim 18 in which the retaining means integrally formed on said housing includes a detent carried by one side wall of each pair in said predetermined position, and the retaining means integrally formed on each member includes a recess in each plate adjacent said free end engaging said detent in response to the flexure of a respective pair of plates toward each other for movement past the detent in said predetermined position.

20. In the switch assembly claimed in claim 19, in which the plates of each pair of plates are identically formed with opposite edges having a recess adjacent the free end of the respective plate for receiving a detent carried by the respective one side wall with either said one plate overlapping said other plate or said other overlapping said one plate.

21. The switch assembly claimed in claim 20 in which said housing includes a common top wall for all of said side walls, and said base includes a barrier wall transverse to said compartment walls overlappped by said top wall and forming a front wall for each chamber.

22. The switch assembly claimed in claim 21 in which said housing and base each include respective integrally formed positioning means for nestingly engaging said base with said housing for aligning each pair of side walls with a respective compartment.

23. In the switch assembly claimed in claim 22 respective means on said top wall and said barrier wall for securing said housing to said base.

* * * * *